United States Patent [19]

Cho

[11] Patent Number: 4,837,948

[45] Date of Patent: Jun. 13, 1989

[54] NATURAL VENTILATION TYPE FOOTWEAR

[76] Inventor: Kang-Rai Cho, 207-305 Garak-Samik Mansion, 395 Pangi-dong, Songpa-ku, Seoul, Rep. of Korea

[21] Appl. No.: 201,900

[22] Filed: Jun. 3, 1988

[51] Int. Cl.[4] ..... A43B 7/06

[52] U.S. Cl. ..... 36/3 A; 36/3 R

[58] Field of Search ..... 36/3 R, 3 A, 3 B, 43

[56] References Cited

U.S. PATENT DOCUMENTS

| | | | |
|---|---|---|---|
| 1,213,941 | 1/1917 | Patrick | 36/3 A |
| 1,394,348 | 10/1921 | Pietrowski | 36/3 A |
| 2,239,211 | 4/1941 | Wycie | 36/3 R |
| 2,614,339 | 10/1952 | Herceg | 36/3 A |
| 3,012,342 | 12/1961 | Ramirez | 36/3 R |
| 3,383,782 | 5/1968 | McGinnity | 36/3 A |
| 3,426,455 | 2/1969 | Drago | 36/3 R |
| 3,624,930 | 12/1971 | Johnson et al. | 36/3 B |
| 4,438,573 | 3/1984 | McBarron | 36/3 B |
| 4,742,625 | 5/1988 | Sydor et al. | 36/3 R |

FOREIGN PATENT DOCUMENTS

| | | | |
|---|---|---|---|
| 1067144 | 1/1954 | France | 36/3 R |
| 506875 | 12/1954 | Italy | 36/3 R |
| 517370 | 2/1955 | Italy | 36/3 A |
| 526712 | 5/1955 | Italy | 36/3 B |
| 497545 | 12/1938 | United Kingdom | 36/3 B |

*Primary Examiner*—Steven N. Meyers

*Attorney, Agent, or Firm*—Fidelman & Wolffe

[57] ABSTRACT

An article of foorwear comprising an improved insole, a vent frame member established in the openings provided on the both sides of the footwear, respectively, including a groove defined along the inward edge of a boundary protrusion thereof, a plurality of vent holes and blind parts in intermittently spaced relationship with each other within the boundary protrusion having a shutter member slidably inserted in the groove so that the vent holes of the frame member can be easily and convienently opened and closed by means of the shutter for circulating outside air into the footwear via the vent holes, a space portion formed between the inner layer of the footwear and a stepped portion formed along the outer periphery of the insole, lateral passages and upper apertures of the insole, whereby allowing exchange of humidity, temperature between the inside and outside of the footwear to provide a better and more comfortable environment for the wearer's foot.

3 Claims, 4 Drawing Sheets

FIG. 3
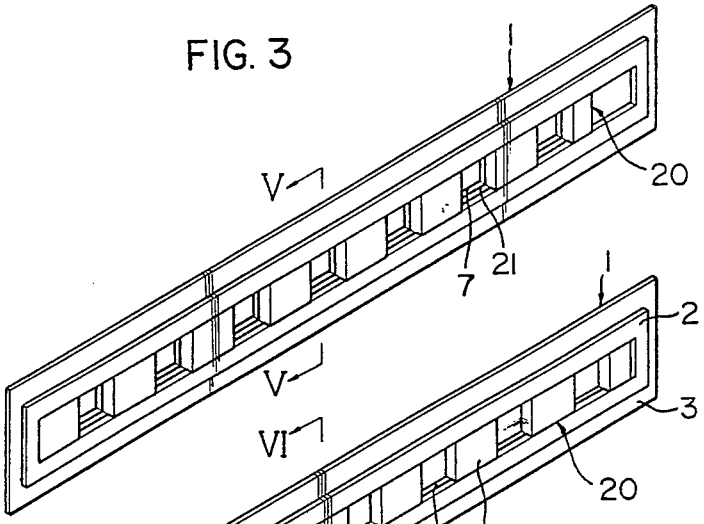
FIG. 4
FIG. 5
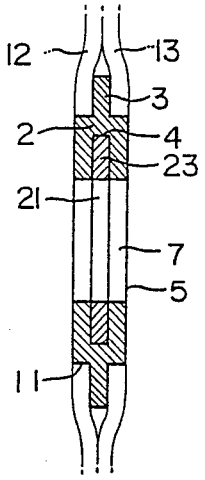
FIG. 6
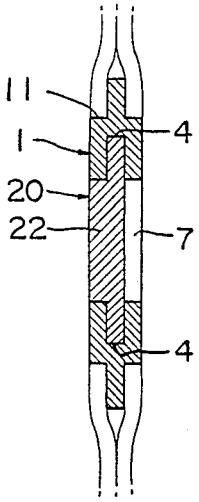

NATURAL VENTILATION TYPE FOOTWEAR

BACKGROUND OF THE INVENTION

The present invention relates to footwear, and more particularly to an improved ventilating shoe which permits exchange of humidity, temperature and air between the inside and outside of the shoe to provide a better and more comfortable environment for the wearer's foot.

It has previously been recognized that it may be desirable to construct articles of footwear incorporating some means for effecting ventilation of the shoe. A variety of such constructions have heretofore been developed for use especially in summer season.

In one of those developed shoes, there are a plurality of small apertures on the both sides of the shoe and numerous apertures on the top surface thereof for providing ventilation to the foot of the wearer reducing perspiration and removing the bad smell emitted from the inside of the shoe.

Another developement is designed so that a complicated valved pumping mechanism incorporated in the outsole and the heel of the shoe effectuates circulation air to the shoe by the valved pumping action.

In such enforced ventilating type shoe, there are a plurality of springs and air passages arranged inside of the outsole and heel portion, thereby introducing air into the shoe and discharging the inner air to the outside.

However, since the shoe of the enforced air circulation type is made to effect the air pumping performance by means of the spring force caused by the walking of the wearer, when the wearer may be seated for office work or riding in a vehicle, the air pumping mechanism will not be actuated to effectuate the air circulation. As the result, the wearer should take off his shoes and then another footwear, for instance a kind of slippers will be necessary for resting his feet on the floor so as to allow for exposing his feet to the fresh air.

The aforementioned vent perforation type shoes have drawback in that on rainy days, the rain drops tend to flow into the shoes through the numerous apertures, thereby getting the wearer's feet wet in the water.

Another drawback is that such vent perforated shoes are adapted only for use in summer season, and therefore another shoes will be necessary for use in winter season.

SUMMARY OF THE INVENTION

An object of the present invention is to provide a natural ventilation type footwear which has openable and sealable shutters installed in the vent frames established on both sides of the shoe.

Another object of the present invention is to provide an improved insole formed with uniformly distributed relatively small holes and lateral passages in communication with the outside atmosphere via the sealable shutters.

For achieving the aforementioned objects, the present invention provides a natural ventilation type footwear having an insole formed with a multitude of uniformly distributed spaced relatively small apertures and lateral passages, a pair of slot-like openings provided on the both sides of a shoe, a vent frame member installed respectively in the slot-like openings, including a plurality of vent holes and blind parts in intermittently spaced relationship with each other and a groove defined along the inward edge of a square type boundary portion protruded from the one wall of each frame member, and a shutter member openably and slidably movable in the groove of each vent frame member and having a plurality of vent holes and blind parts in intermittently spaced relationship with each other.

The insole in accordance with a preferred embodiment of the present invention comprises a stepped portion defined on the outer periphery of the insole, a multitude of upper apertures uniformly distributed spaced on the surface thereof, a multitude of lateral passages uniformly distributed spaced on the stepped portion in open communication with the upper apertures, and a space portion provided between an inner wall of the shoe and the stepped portion in correspondence with the vent holes of the vent frame member.

With the above-described construction, the following function is obtained.

Since the vent frame member is installed in each slot-like opening of both sides of the shoe in normal stitching manner or by adhesive agent and the shutter member is slidably inserted in the groove of each vent frame member, the shutter can be easily and conveniently moved to open or close the vent holes defined on the vent frame member.

The wearer, if desired, arranges the vent holes of the shutter member to the vent holes of the vent frame member for communicating between the inside and outside of the shoe so that the outside air can be introduced into the shoe and on the contrary, the inner air of the shoe can be discharged to outside via the vent holes.

Therefore, the outside air introduced through the vent holes will be circulated along the space portion formed between the inner wall of the shoe and the stepped portion of the insole.

The circulating air in the space portion will be flowed into the lateral passages formed on the outer periphery of the stepped portion, and also the lateral passages are communicated with the upper apertures uniformly distributed spaced on the surface of the insole.

Thus, the upper apertures will provide ventilation to the wearer's foot, thereby reducing perspiration and burning of the foot and also eliminating the bad smell emitted from the foot.

Furthermore, the air circulation will prevent the feet from a skin disease, e.g., athlete's foot and simultaneously will relieve the wearer's fatigue.

On the other hand, the vent holes of the vent frame member, if desired, will be closed by the shift of the shutter member so that the shoe can be used on rainy days, or in winter season, and consequently, the shoe according to the present invention has an economical advantage.

These and other objects as well as advantages of the present invention will become apparent to those skilled in the art upon consideration of the following detailed description of a preferred embodiment exemplifying a best mode of carrying out the invention as presently perceived.

BRIEF DESCRIPTION OF THE DRAWINGS

FIG. 3 is a perspective view showing the opening state of the shutter and the vent frame members in combination with each other;

FIG. 4 is a perspective view showing the closing state of the shutter and the vent frame members in combination with each other;

FIG. 5 is a longitudinal cross-sectional view taken along the line V—V of FIG. 3;

FIG. 6 is a longitudinal cross-sectional view taken along the line VI—VI of FIG. 4;

DETAILED DESCRIPTION OF PREFERRED EMBODIMENT

Figure 1:
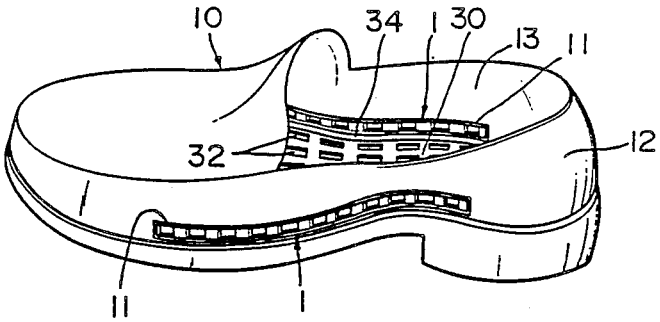
FIG. 1 is a perspective view of an embodiment of a shoe according to the present invention.
Figure 2:
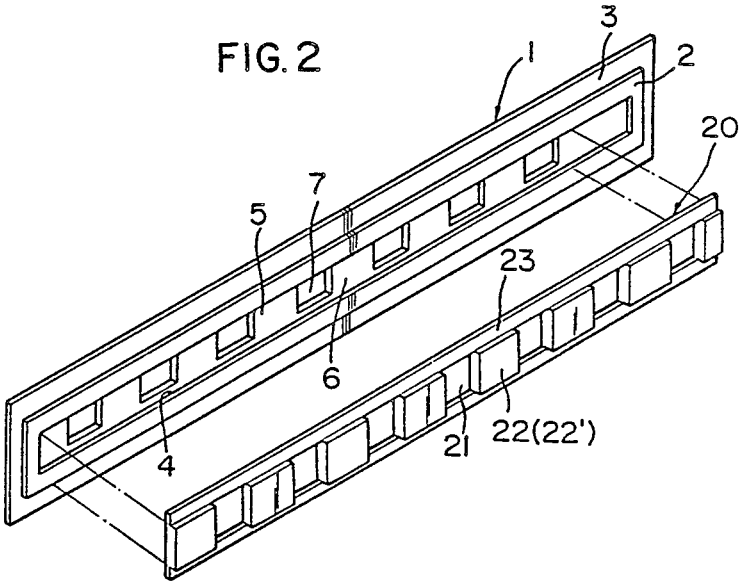
FIG. 2 is an exploded view of a shutter and a vent frame members employed in the shoe according to the present invention.
Figure 7:
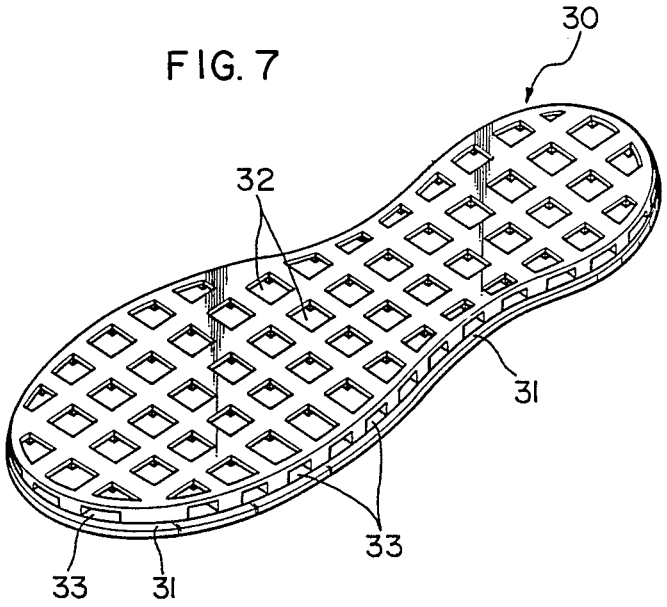
FIG. 7 is a perspective view of an embodiment of an insole employed in the shoe according to the present invention.
Figure 8:
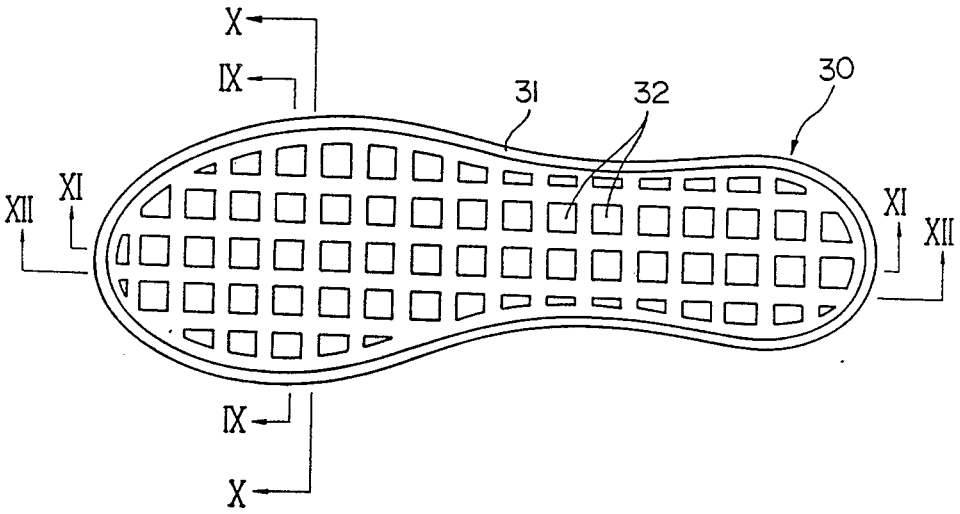
FIG. 8 is a top plan view of the insole of FIG. 7.
Figure 9:
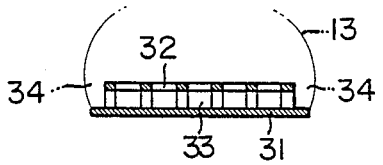
FIG. 9 is a longitudinal cross-sectional view taken along the line IX—IX of FIG. 8.
Figure 10:
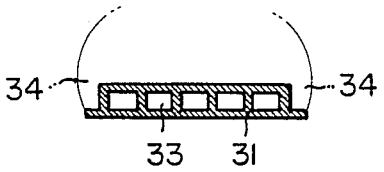
FIG. 10 is a longitudinal cross-sectional view taken along the line X—X of FIG. 8.
Figure 11:
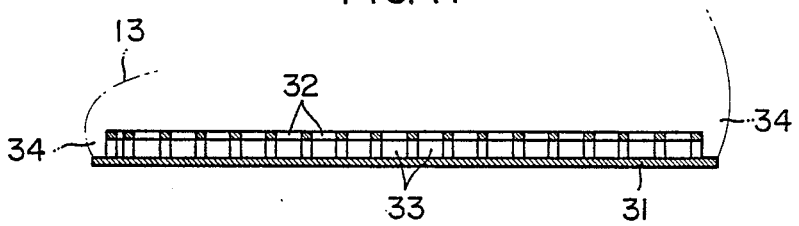
FIG. 11 is a longitudinal cross-sectional view taken along the line XI—XI of FIG. 8.
Figure 12:
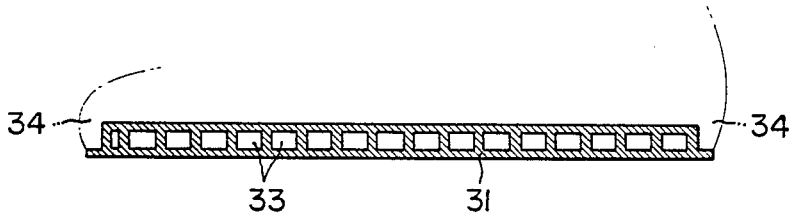
FIG. 12 is a longitudinal cross-sectional view taken along the line XII—XII of FIG. 8.

The present will now be explained in detail by way of a preferred embodiment thereof in conjunction with accompanying drawings herewith. Referring firstly to FIG. 1, there is shown a complete shoe of an embodiment according to the present invention designated at the reference numeral 10. A slot-like opening 11 is provided on the both sides of the shoe 10, respectively.

As shown in FIGS. 2–6, a vent frame member 1 to be installed respectively in the openings 11 comprises a square type boundary frame 2, a peripheral portion 3, a wall 5 and a groove 4 formed along the boundary 2 protruded from the wall 5.

The wall 5 includes a plurality of vent holes 7 and blind parts 6 in intermittently spaced relationship with each other within the boundary frame 2.

The vent frame member 1 is installed respectively in the openings 11 in such manner that the peripheral portion 3 is inserted between an outer cover 12 and an inner layer 13 of the shoe 10, and then stitched together with them or attached with each other by adhesive agent as shown in FIGS. 5–6.

As shown in FIGS. 2–6, a shutter member 20 comprises two edge ends 23 on the upper and lower thereof, a plurality of vent holes 21 and blind parts 22′ in intermittently spaced relationship with each other and also in correspondence with the vent holes 7 and the blind parts 6 of the vent frame member 1 and each blind part 22′ has a protrusion 22.

The shutter member 20 is slidably inserted in the vent frame member 1 in such manner that the upper and lower edge ends 23 are slidably inserted into the groove 4 of the boundary frame 2, so that the protrusions 22 are engaged between the upper and lower portions of the boundary 2.

On the other hand, as shown in FIGS. 7–12, an insole 30 of the shoe 10 according to the present invention comprises a stepped portion 31 along the peripheral edge thereof so that a space portion 34 is formed between the inner wall 13 of the shoe 10 and the stepped portion 31 in correspondance with the vent holes 7 of the vent frame member 1, a multitude of relatively small apertures 32 uniformly distributed spaced on the surface of the insole 30, and a multitude of lateral passages 33 defined on the stepped portion 31 in open communication with the upper apertures 32.

As illustrated in the drawings, though the configuration of the vent holes 7 & 21, apertures 32 and the lateral passages 33 are of square, they may be of circular, oval, curvilinear, angular or polygonal cross-section or any combination of them.

Described hereunder in detail is the function of an embodiment of the shoe according to the present invention.

The peripheral portion 3 of the vent frame member 1 is attached between the outer cover 12 and the inner layer 13 through each slot-like opening 11 by the stitching manner or by adhesive agent for providing ventilation to the shoe 10 via the vent holes 7.

At that time, while the upper and lower edge ends 23 of the shutter member 20 are slidably inserted in the groove 4. the protrusions 22 of the shutter member 20 are disposed within the boundary frame 2 so that the shutter member 20, if required, can be moved to open the vent holes 7 by aligning with the vent holes 21 of the shutter member 20.

Therefore, the outside air will be introduced into the shoe 10 via the vent holes 7 & 21 in folded state, and then the inlet air is circulated around the space portion 34 formed between the inner wall 13 of the shoe 10 and the stepped portion 31 of the insole 30.

The circulated air is introduced into the lateral passages 33 formed on the stepped portion 31, and further flowed into the numerous apertures 32 unformly distributed spaced on the surface of the insole 30.

The inlet air allows for contact with the foot of the wearer, thereby providing ventilation to the foot.

The ventilation permits exchange of humidity, temperature and air between the inside of outside of the shoe 10.

This will reduce or prevent perspiration, burning of the feet, athlete's foot and provide a better and more comfortable environment for the feet.

Moreover, on rainy days or in winter time, the shutter member can be easily arranged with its blind parts 22′ to the vent holes 7 of the frame member 1 so as to block the vent holes 7. The ventilation will not be effected to the shoe which can be used as a normal type shoe.

While an embodiment of the present invention has been described in terms of its structures, functions and effects, the present invention is by no means restricted to the embodiment and naturally includes the examples discussed below.

In the above-described embodiment, the vent frame member 1 is independently designed, but also the vent frame member may be integrally provided on the both sides of the shoe so that the groove 4 can be defined between the inner layer and the outer cover of the shoe. If the shoe is made of only one surface cover, the vent frame member may be integrally on the both sides of the shoe, and then only square type boundary protrusion can be easily provided on the vent frame member.

It is also to be understood that the appended claims are intended to cover all of such generic and specific features particular to the invention as disclosed herein and all statements relating to the scope of the invention, which as a matter of language might be said to fall thereunder.

What is claimed is:

1. An article of footwear, comprising:

an outsole;

an upper attached to an upper surface of the outsole, said upper having a heel end, a toe end, and two opposing side walls, wherein a rectangular slot is formed in each opposing side wall;

an insole located in said upper and having an upper surface and an outer lateral surface, said upper surface having a plurality of openings located therein, said outer lateral surface having a plurality of passages therein, said openings and said passages being in communication with each other;

a vent frame member attached to each opposing side wall of the upper and having a rectangular boundary frame which defines an opening aligned with one of the rectangular slots and an inner peripheral wall, a groove located in the inner peripheral wall of the boundary frame, and a plurality of alternating vent holes and blind parts located in the opening defined by the boundary frame, the vent holes of each vent frame member communicating with the passages located in the outer lateral surface of the insole; and a shutter member located in each of the vent frame members, and having opposing edge portions which are slidably engaged in the groove of each of the vent frame members and a plurality of vent holes and blind parts, each of said shutter members being movable between a position where the vent holes of the shutter member are aligned with the vent holes of one of the vent frame members, and a position where the blind parts of the shutter member are aligned with the vent holes of one of the vent frame members.

2. The ventilated footwear as claimed in claim 1, wherein said insole further comprises a stepped portion extending around the insole and projecting outwardly from the outer lateral surface, said stepped portion contacting the side walls of the upper so as to define a space portion between the side walls of the upper and the outer lateral surface of the insole, said space portion communicating with the passages located in the outer lateral surface of the insole and with the vent holes of each of the vent frame members.

3. The ventilated footwear as claimed in claim 1, wherein the boundary frame of each vent frame member further defines an outer peripheral surface, wherein each vent frame member further comprises a peripheral portion extending outwardly from said outer peripheral surface of the boundary frame, and wherein said upper comprises an inner layer and an outer layer, the peripheral portion of each vent frame member being fixed between said inner layer and said outer layer.

* * * * *